US009523213B2

(12) United States Patent
Pyaga

(10) Patent No.: US 9,523,213 B2
(45) Date of Patent: Dec. 20, 2016

(54) HEMISPHERICAL, BREATHABLE, DOUBLE-WALL, ALL-SEASON, PORTABLE BUILDING

(71) Applicant: Adonata Pyaga, Santa Fe, NM (US)

(72) Inventor: Adonata Pyaga, Santa Fe, NM (US)

( * ) Notice: Subject to any disclaimer, the term of this patent is extended or adjusted under 35 U.S.C. 154(b) by 3 days.

(21) Appl. No.: 14/620,503

(22) Filed: Feb. 12, 2015

(65) Prior Publication Data

US 2016/0237716 A1 Aug. 18, 2016

(51) Int. Cl.
*E04H 15/10* (2006.01)
*E04H 15/36* (2006.01)
*E04H 15/16* (2006.01)

(52) U.S. Cl.
CPC ..... *E04H 15/36* (2013.01); *E04H 15/10* (2013.01); *E04H 15/16* (2013.01)

(58) Field of Classification Search
CPC ..... E04H 15/10; E04H 15/12; E04H 15/16; E04H 15/36; E04H 15/42; E04H 15/54; E04H 2015/207
USPC 135/87, 92, 135, 156, 115, 906–908; 52/63, 82–83
See application file for complete search history.

(56) References Cited

U.S. PATENT DOCUMENTS 3,448,748 A * 6/1969 Walrave ..... E04H 15/003 135/114
3,970,096 A 7/1976 Nicolai
4,192,334 A * 3/1980 Daws ..... E04B 1/3211 135/135
4,332,112 A 6/1982 Hsu
5,078,096 A * 1/1992 Bishop ..... A01K 1/0254 119/497
5,305,564 A 4/1994 Fahey
5,421,355 A * 6/1995 Cantwell ..... E04H 15/425 135/115
5,970,661 A * 10/1999 Bishop ..... E04H 15/006 135/125
6,167,898 B1 * 1/2001 Larga ..... E04H 15/20 135/124
6,334,456 B1 1/2002 Nevak
6,397,869 B1 * 6/2002 Jennings ..... E04H 15/14 135/120.1
6,499,497 B1 * 12/2002 Swetish ..... E04H 15/16 135/115
6,679,009 B2 1/2004 Hotes
(Continued)

*Primary Examiner* — Winnie Yip

(57) ABSTRACT

A portable building for all seasons combines elegant design with durability and functionality. An air pocket between two walls creates efficient thermal insulation in winter. Endures high winds with a flexible wall and frame system. Self supportive, ground-anchored with steel stakes and sewn as a single hemisphere provide strength and stability. 100% renewable and breathable fabric promotes health, allows intimate nature contact and is affordable. Lightweight, foldable to 0.6% of assembled volume, transportable by car, it can be assembled by one person repeatedly. Detachable, replaceable mosquito screens, clear vinyl and privacy blinds maximize use of each passageway. Skylights, natural toned UV filtered light, arched passageways and vaulted high ceilings free of angular shapes combine to create an atmosphere of serenity and simple elegance enhancing creativity and physical wellbeing. Synergistic features provide comfort for all everyday human activities making it suitable, and environmentally-friendly for long-term use off-grid.

11 Claims, 5 Drawing Sheets

(56) References Cited

U.S. PATENT DOCUMENTS

| | | | | |
|---|---|---|---|---|
| 6,681,786 | B2 * | 1/2004 | Ju | E04H 15/48 135/118 |
| 7,195,025 | B2 * | 3/2007 | Choi | E04H 15/32 135/117 |
| 7,222,635 | B2 * | 5/2007 | Cantwell | E04H 15/54 135/115 |
| 7,954,504 | B2 * | 6/2011 | Price | E04H 15/425 135/119 |
| 2009/0188539 | A1 * | 7/2009 | Hollinger | E04H 15/22 135/115 |

* cited by examiner

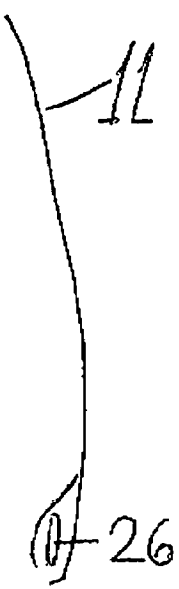
FIG. 8
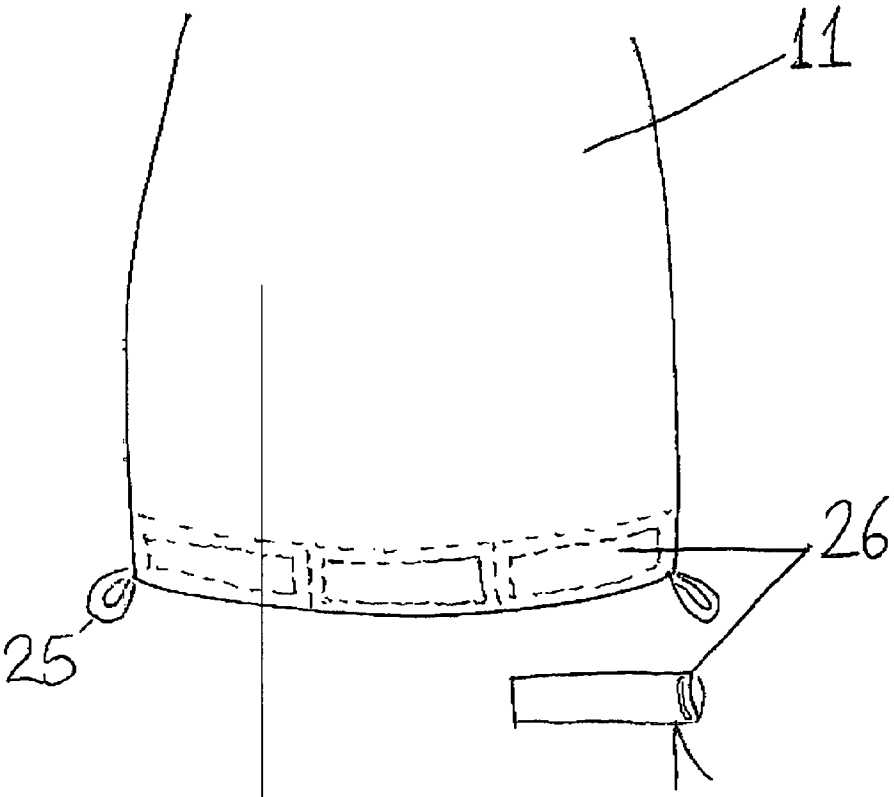
FIG. 9
FIG. 7

HEMISPHERICAL, BREATHABLE, DOUBLE-WALL, ALL-SEASON, PORTABLE BUILDING

STATEMENT REGARDING FEDERALLY SPONSORED R&D

None

NAMES OF PARTIES TO A JOINT RESEARCH AGREEMENT

None

CROSS REFERENCE TO RELATED APPLICATIONS

None

BACKGROUND OF THE INVENTION

1. Field of the Invention

The present invention combines the features of portability, compactness and ease of assembly typical of a shelter, with the esthetic and functional comforts typical of a more permanent building. It uniquely combines convenience and refined esthetic appeal appropriate for short or long term use for the purpose of leisure, work, off grid and rescue missions.

2. Description of the Prior Art

Portable buildings have been their origins in our nomadic past. Since the onset of agriculture more permanent buildings have been established, providing us with solid protection from harsh elements, and providing us with great architectural beauty and comfort. Modern day portable buildings lack esthetic appeal, lack durability in all climatic regions, and thus only inadequately supply the level of comfort that human beings are accustomed to enjoy.

U.S. Pat. No. 6,679,009 B2 describes a compact, all-weather temporary shelter for military application. While it has arched vertical supports, its base is rectangular. While it has two fabric layers, the outer layer is not breathable thus does not allow a healthy exchange of air with the outside. Doors and windows are rectangular, lacking esthetic consideration.

U.S. Pat. No. 3,970,096 similarly describes a double-wall tent of semicylindrical shape. However, its outer fabric is held in place with extended guy lines thus not being self-supporting, and it is non-porous.

U.S. Pat. No. 5,305,564 describes a hemispherical dome building structure, however it is constructed of rigid cells and requires to be built on poured concrete foundation, thus failing the requirement of portability.

U.S. Pat. No. 6,334,456 B1 describes a multi-level portable housing structure appropriate for field work. While it is of hemispherical shape, it features only a single layer and is not suitable for winter weather.

Finally, U.S. Pat. No. 4,332,112 describes a multipurpose air filling tent featuring a square-shaped skylight on top, which lacks the esthetic appeal of an arch-shaped skylight.

Thus, in the patent literature there is no precedent for a building that combines durability and portability with breathability. There is also none that combines all these features with a hemispherical shape, high ceilings, the presence of arch-shaped walls, windows, doors and skylights.

SUMMARY OF THE INVENTION

The present invention relates to a portable building that is made of breathable, flexible walls, a flexible frame and a double-wall technology with an air space in between that provides efficient thermal insulation; it is hemispherically shaped, highly durable, performs well in snow, wind, rain and under ultraviolet rays, thus performing exceptionally well in all seasons and climatic regions. Of high esthetic appeal and comfort for prolonged use, it features a plurality of radially sewn petal-shaped fabric panels, high vaulted ceilings with skylights, breathable fabrics of natural tone, three window and door layers for all weather conditions, detachable screens, a central weight-bearing hub, continuous sleeves, unseen zippers and anchoring sandbag pockets. It is anchored to the ground with portable steel stakes, it does not require any guy lines, and thus it is self-supportive and stable.

It is therefore the primary object of the present invention to provide easy and efficient thermal insulation for remote off-grid locations of limited energy resources. This present invention has been field-tested over a period of four years in widely differing climatic circumstances. Its most efficient configuration comprises of two breathable walls separated by a gap of a few inches. The air pocket formed in between walls acts a thermal mass, in other words, it acts as a material of insulative value. When the building is heated from the inside with an energy efficient propane heater, such as Mr. Heater Portable Buddy, or any other radiant heating source, it heats all the objects and occupants in the building. This design allows the majority of the heat to remain inside due to the two walls and the air space in between. Only one 20 pound tank is needed for up to 70 hours of continuous heating in the coldest of climates. In this way no heavy wood stoves nor costly and electrically dependent HVAC heating and cooling systems are needed. During summer, windows strategically facing all four directions allow a flow of ventilation that is rarely achieved in other buildings, as they are internally partitioned such as to block a cross-ventilation flow, or because they lack windows in all directions. The addition of mosquito screens over all openings permit the free flow of air without the invasion of summer insects that can make remote locations inhospitable. The double wall layer shades the interior in such a way that the temperature is cooler by 5 to 10° F. When positioned near or under a tree, field tests show an additional 5 to 10° F. of drop of temperature in hot weather.

It is an object of the present invention to be stable in storms. The shape of a sphere has long been known to be the strongest shape in nature. A half sphere anchored to the ground with steel stakes is even more stable. A plurality of petal-shaped fabric wall panels radially assembled and attached at seams to a flexible frame allows the entire hemisphere to sway gently as one unit during excess winds and trembling grounds. This is the most desirable civil engineering design for newer buildings in a changing earth landscape. In conditions of deep snow, keeping the interior above freezing with a small propane heater is sufficient to melt all snow off the top shortly after it lands.

It is an object of the present invention to sustain long term use. Sun exposure deteriorates most fabrics in a disappointingly short period of time. At high altitude and dry deserts this becomes even more significant. The preferred embodiment uses a heavy duty canvas which has been treated with the highest quality UV protection. The quality of the canvas also allows exterior storms and typical human activities held indoors to not interfere with its durability.

It is an object of the present invention to be easily transportable. The entire building folds down into two separate bags weighing 65 and 55 pounds each in its preferred embodiment, and occupying the space of two oversize contractor waste disposal bags. An 18 pound hub, 12 steel stakes and 12 flexible PVC pipes of 14 feet in length are the remaining accessories. These can easily fit in any size personal vehicle as pipes bend 270° without effort. The total volume averages 0.6% of the finished building. Larger portable building sizes not described herein can also be carried by aircraft, boats and larger vehicles.

It is an object of the present invention to provide a quick assembly time for its user(s). A single person typically assembles the present embodiment described herein within two hours. With the help of three others it can be assembled in 30 minutes. This portable building can be assembled more quickly when it is configured of smaller dimensions, and slightly slower when it is configured of larger dimensions. The time to disassemble any of them is half of the set up time.

It is an object of the present invention to be good for humans' health. Conventional buildings are frequently built with modern materials that contain toxic substances and materials that are impermeable, not allowing the occupant to breathe and exchange air with the external environment. The preferred embodiment of the present invention is made of 100% natural cotton canvas, and further treated with non-toxic treatments for protection from water, mildew, ultra-violet rays, fire, and shrinking. in this way the components of the building remain 100% natural and healthy. With all walls being porous and permeable to the outside, it permits a continuous presence of fresh air indoors, even when all, openings are sealed. The absence of stale air and chemicals dramatically improves the physical well being of occupants, as stated by those who have occupied it thus far.

It is an object of the present invention to provide a portable building made entirely of renewable materials. This invention is made predominantly of 100% heavy duty cotton canvas. The unbleached cotton industry is based on the growth of cotton trees which are a 100% renewable resource. Less than 1% of the total building materials is polyvinyl chloride (PVC). Polyvinyl chloride can be recycled seven times in the course of its useful life, and comprises less than 1% of total building materials. The impact on environmental health for future generations is positive.

It is an object of the present invention to provide an economical building. The cost of base materials is low compared to other building materials. The process of manufacturing is low tech and affordable. The end user will receive a cost-effective portable building for a variety of uses. The cost of shipping and transportation is minimal due to its small size and light weight.

It is an object of the present invention to permit occupants to experience the cycles and elements of nature closeup while still fully sheltered and in comfort in any weather. This is achieved with permeable, hollow fabric walls. Their lack of sound barriers allows for all sounds in the surroundings to be brought inside. Their breathability allows fresh air to be indoors at all times, even during cold weather. In this way the occupant perceives the building as simply a thin membrane that connects him or her to the outdoors rather than segregates him or her. The generously sized windows and door allow open visual access to the natural surroundings, be they a backyard or a safari.

It is an object of the present invention to provide a therapeutic effect. Its lofty height and circular shape free of any sharp angles or busy lines creates an atmosphere of serenity. Its UV-filtered light passing through natural cream tones maintains a warm golden tone in the interior whether it is sunny or cloudy, having an uplifting effect. Arched walls, windows and doors add beauty and enhance subjective well being. These features plus the fresh indoor air and the permeable walls bringing the sounds of nature indoors, all combine to calm the occupant, uplift their thoughts and moods, making it an environment conducive to meditation and The unfoldment of creative ideas.

It is an object of the present invention to provide a portable building that offers human comfort similar to that available in a permanent building. Fully functional independently operating windows consisting of a mosquito screen, a clear vinyl layer, and a privacy blind are adjustable for all weather needs. Vertical interior walls provide ease of storage, conventional furniture placement and unrestricted customary human movement. High ceilings offer a subjective experience of spaciousness in a limited square foot area.

It is an object of the present invention to create a structure of architectural beauty and elegance. High vaulted ceilings, the absence of angular lines shaping the walls, arch-shaped windows, doors and skylights, its overall hemispherical shape, unseen zipper closures, and impeccable finishes all combine to create a luxurious, high-end design not seen elsewhere in portable building industry.

BRIEF DESCRIPTION OF THE DRAWINGS

FIG. 7 is a fragmentary front view of bottom of outer layer of portable building of the present invention.

FIG. 8 is a fragmentary cut-away side view of bottom of outer layer of finished portable building of the present invention.

FIG. 9 is a front view of a sandbag for finished portable building of the present invention.

DETAILED DESCRIPTION OF THE INVENTION

1. Definitions

The term breathable as used herein, in the context of breathable walls, shall mean any material that permits departure of moisture and condensation derived from human activity and objects stored in the shelter. Army duck canvas is such a material, and is the one predominantly used in this invention, Other natural fabrics may apply, as well as synthetic ones with breathable properties, such as nylon ripstop.

Flexible frame as used herein refers to any hollow or solid pipe, tube or rod made of plastic such as polyvinyl chloride (PVC), metal, fiberglass, carbon fiber, aluminum alloy, bamboo or other wood, provided that the material has the property of manually bending into a curve with ease, and restoring its natural shape when not in use.

Figure 4:
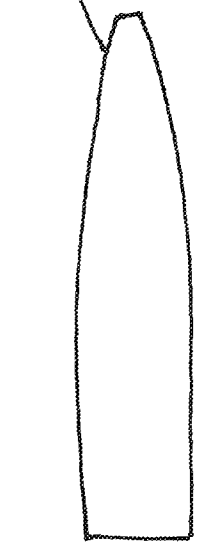
FIG. 4 details shape of one wall panel of the portable building of the present invention.
Figure 3:
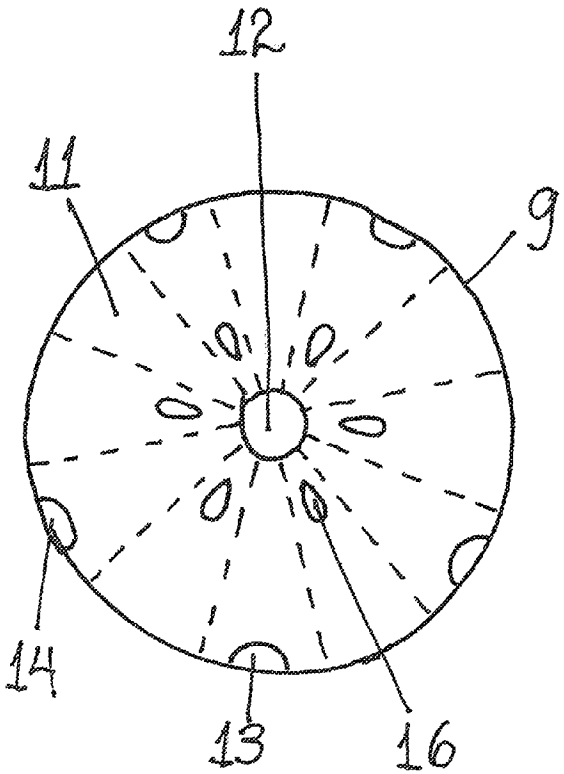
FIG. 3 is a top view of finished portable building of the present invention.

The term petal-shaped as used herein shall mean a long and narrow trapezoid with a wider base and a narrower top, whereby its vertical sides have a gentle concave curve, as shown in FIG. 4.

The term hemispherical as used herein shall mean a shape comprising of the upper half of a sphere, and reasonably extended or shortened depending on the overall size of shelter, so as to maintain a spacious interior height for human use, but not altered so significantly that its half spherical shape is visually lost.

Figure 10:
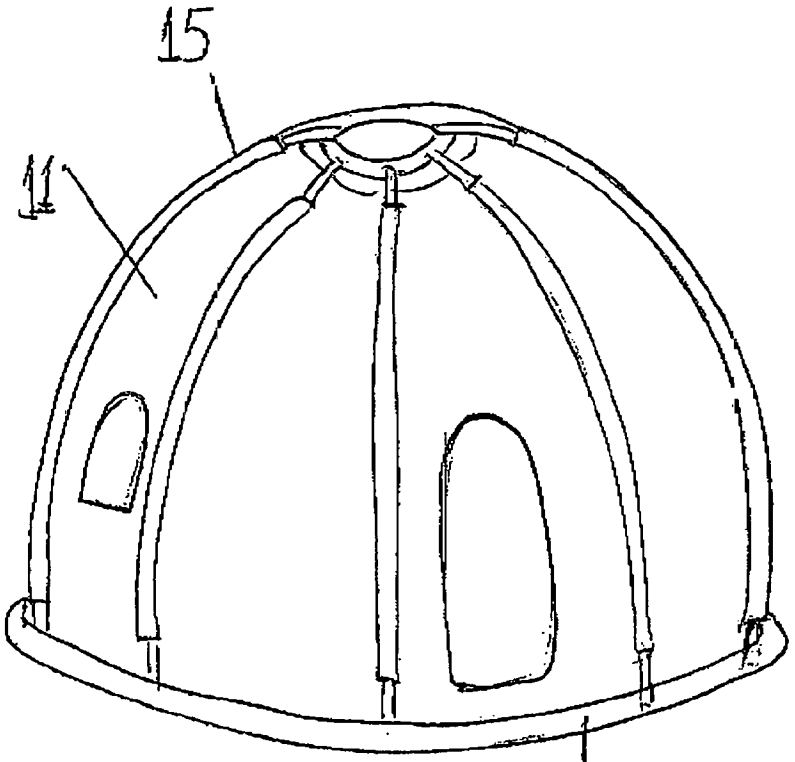
FIG. 10 is a front view of inner layer anchored to a wooden frame that sits above ground.

Arched as used herein used shall pertain to any polygonal shape with at least two concave sides, as shown in FIG. 10 and applies to the walls and all openings.

The term fabric frame as used herein shall mean a covering for any openings wide enough to cover zippers or raw fabric edges completely.

Openings as used herein shall mean windows, doors, vents, skylight, and passages for utilities' accessory lines.

The term unseen zipper as used herein shall mean a regular zipper completely covered by a finished water-resistant fabric frame so as to create a pleasant esthetic finish, and so as to minimize contact with the elements. It shall not mean an invisible zipper as defined in the sewing industry.

Closed sleeve as used herein shall mean a continuous fabric cylinder of appropriate length made of durable weather-resistant fabric for the purpose of inserting a pipe or rod.

Open sleeve as used herein shall mean a long continuous strip of weather-resistant fabric with one of the following attachments: hook and loop fastener, a plastic or metal snap-on hook, for the purpose of securing building walls to a pipe or rod.

Weather-resistant fabric as used herein shall mean a fabric treated for water resistance, mildew resistance, ultraviolet (UV) protection and preshrinking. A good example is Sunforger®. It is made of 100% cotton canvas that has a proprietary non-toxic treatment of all the aforementioned. Sunforger® also has a non-toxic fire retardant treatment this inventor most frequently uses.

Elements as used herein, shall mean events naturally occurring in nature such as rain, snow, wind, sun, heat, cold, moisture, dust and salt.

Radiant heating as used herein shall mean any form of heat that warms the objects and individuals in the room, in contrast to heating the air, and which are typical of any infrared sources such a propane or natural gas heater, or an open fire. This is in contrast to convection heating, which shall mean any form of heat that warms the air in the room, such as a wood stove, and its effectiveness is dependent on maintaining the indoor air unchanged.

2. Best Mode of the Invention

Figures 1, 2, 2A:
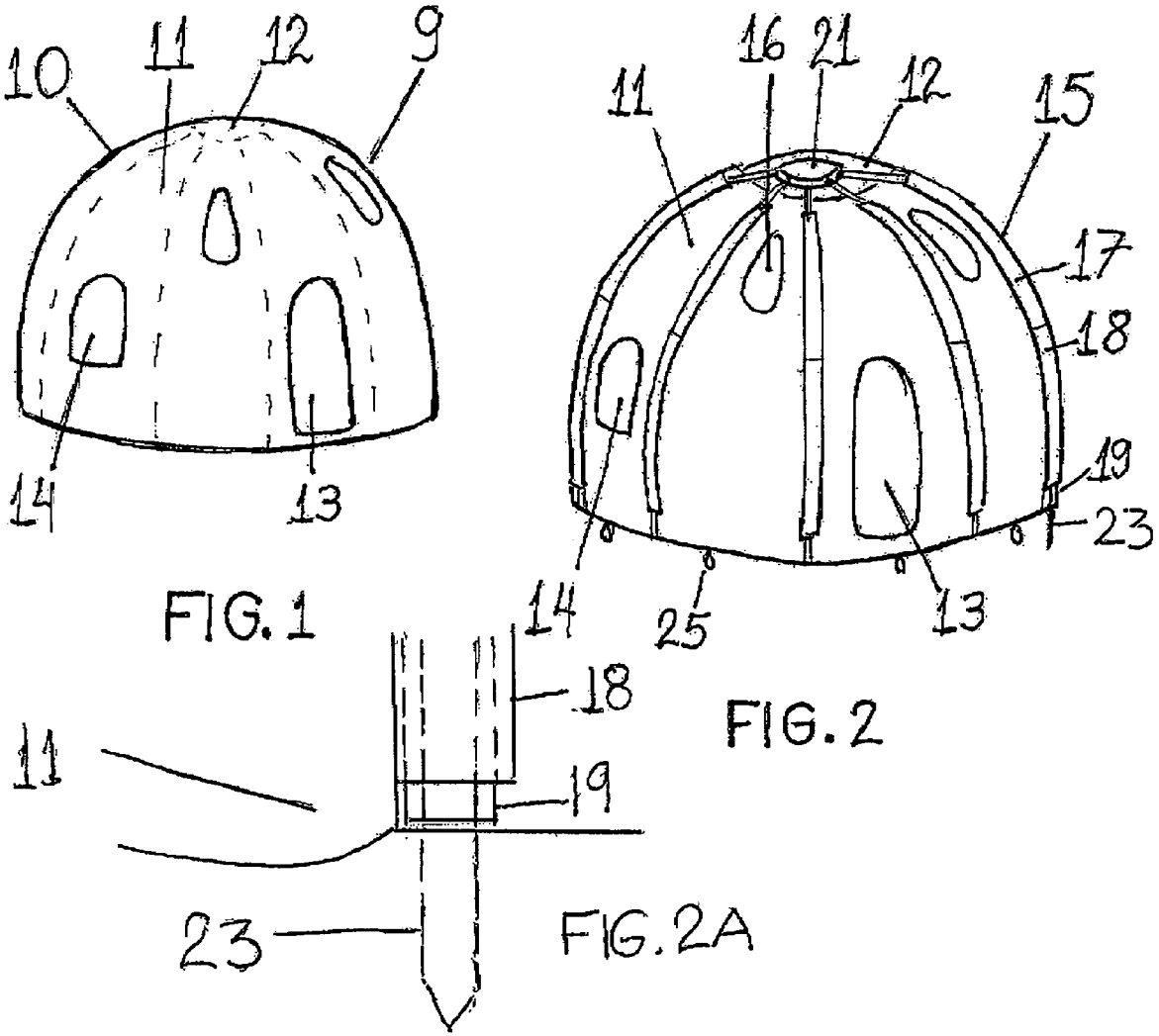
FIG. 1 is a front view of finished portable building of the present invention.
FIG. 2 is a front view of inner layer of the portable building of the present invention.
FIG. 2A is a fragmentary side view of ground stake.

FIG. 1 shows a front view of the best mode contemplated by the inventor of the portable building 10 according to the concepts of the present invention.

3. How to Make the Invention

FIG. 1 shows the preferred embodiment wherein the portable building 9 has a diameter of 15 feet and a height of 10 feet. This shape allows for nearly vertical walls preferred for all human movement, maximizing space for the addition of functional furnishings and other storage use. The overall height adds a feeling of spaciousness and well being characteristic of all dome-shaped architecture throughout the ages. Both outer and inner walls are made of 10-13 ounces 100% cotton canvas of the highest quality, preshrunk, treated for water resistance, mildew protection, ultra violet resistance, and as appropriate, for fire retardancy. An example of such fabric is Sunforger® manufactured by MF&H Textiles Inc in Georgia, USA.

Both walls are made of twelve petal-shaped panels 11 vertically sewn and meeting at the center top with a sewn canvas circle 12 of a diameter of two feet. This circle conceals a zipper that can be opened for convenience during setup, and sewn with a two inch fabric border, so that no water can pass through it. The presence of these arched lines and the absence of triangles and pentagons, is a unique design feature that adds serenity and wellbeing to its occupants, as attested by all those who have come inside.

FIG. 2 shows the inner layer 15 of portable building. The inner walls 11 are sewn to a waterproof circular fabric floor, such as a heavy duty mildew resistant and puncture resistant polyethylene tarp, sealing the whole interior from the possible visit of insects, rodents and the like. The preferred embodiment exemplifies a building with one door 13 and four windows 14. The inner door 13 is a sewn-in zippered canvas privacy blind with two double pulls so as to be readily opened from either side and so as to be partially opened as desired. The door 13 is not zippered on the left side, but rather permanently sewn in, acting as a hinge and replicating a standard door. It can be rolled away to the side and held in place by fabric fasteners when it is desirable to leave the door open. Immediately following it is a flexible screen layer such as mosquito netting that prevents the passage of even the smallest of insects such as no-see-umm. It can also be rolled away to the side and fastened with fabric ties. It has the unique feature of having a hook and loop fastening system, whereby a loop strip is sewn onto the zippered screen periphery and an identical hook strip is sewn to the door's fabric frame exterior, so as to be out of sight, and such that in the event of damage to the screen, said screen can easily be removed and replaced by a new one without the need to disassemble and ship the entire structure back to its manufacturer. This is important because screens are the only material at peril of being easily damageable during heavy use in this whole construction.

All four arch-shaped windows 14 share the exact same features as the door, excepting that they are hinged at the horizontal bottom line, and can be rolled up out of the way with fabric ties or simply left to hang between both wall layers. Skylights 16 can be added where desirable to one or more panels 11. These do no open as they are out of reach.

Figure 6:
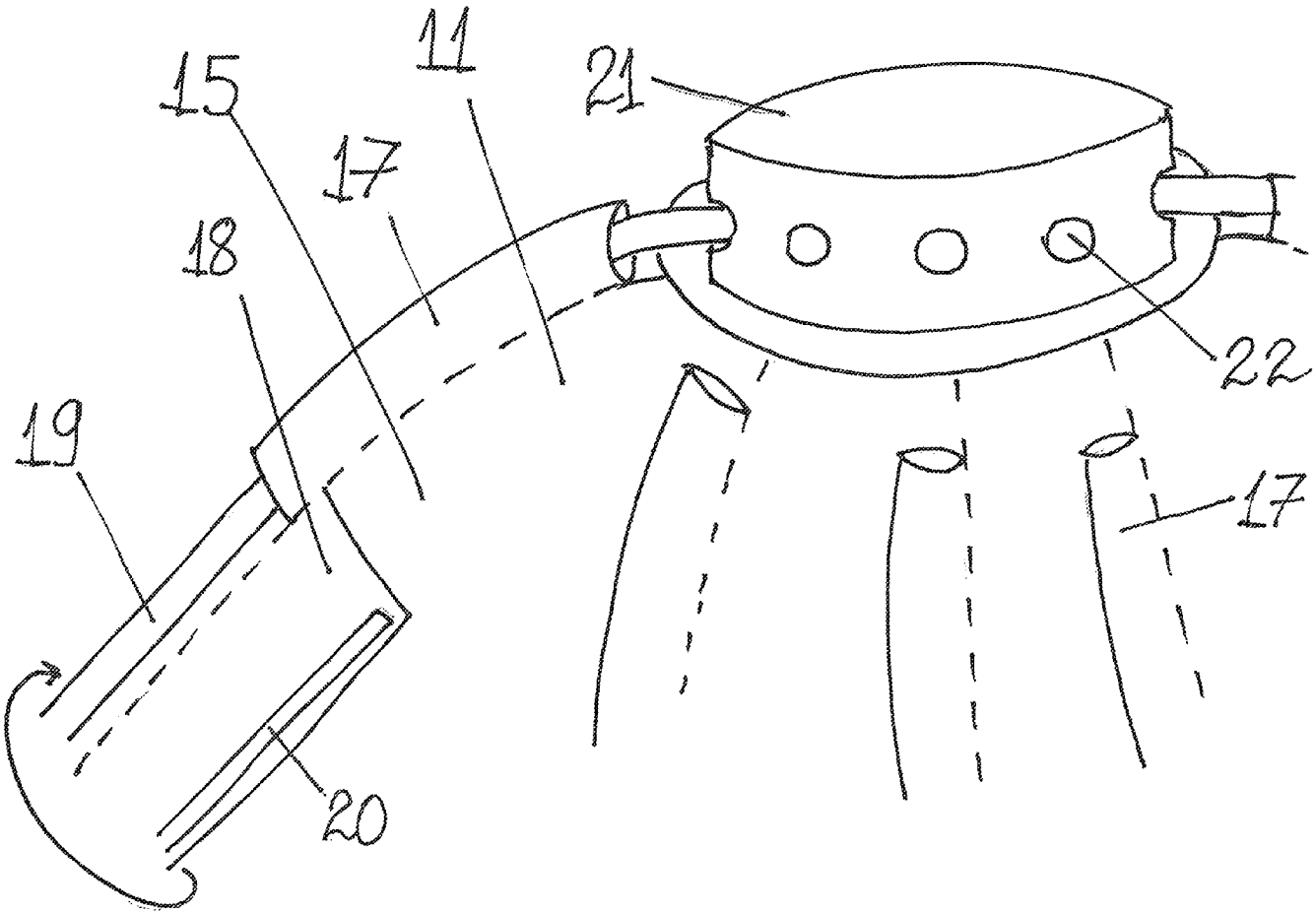
FIG. 6 is a fragmentary side view of center top hub and sleeves of portable building of the present invention.

FIG. 6 shows the sleeve fastening system. The inner layer 15 of this building is attached with fitted canvas sleeves 17 and 18 to a semi-rigid frame 19, shown here in its preferred embodiment as PVC. The sleeves 17 and 18 are sewn to the outside of the existing vertical seams of the petal-shaped panels 11, and consist of a top closed sleeve 17, and a lower open sleeve 18 which overlaps it by three inches. The open sleeve 18 consists of two long strips of canvas each with one portion of a hook and loop fastening system 20 of industrial strength. This design permits the ease of insertion of the PVC pipes 19 during initial assembly, and once the center top of structure is situated, the lower sleeves 18 are securely closed. The overlapping of the sleeves 17 and 18 adds an extra layer of protection of the pipes 19 from the elements, increases structural stability and maintains the visual beauty of the arched wall line as seen from the outside, The entire pipe frame 19 is thus covered with these two sleeves 17 and 18, excepting at the very top where a few inches of roomy is given to facilitate insertion of pipes into a center hub 21.

The feature of continuous sleeves significantly distributes the strain applied to the pipes 19 to be even throughout, and accurately maintains the curved hemispherical shape at all times.

The hub 21 as shown in FIG. 6 is made of solid wood, approximately 5 inches thick, 18 inches in diameter and weighing around 18 pounds. Twelve holes 22 evenly spaced around its sides are 3.5 inches deep and of 1-⅛" diameter, permitting a deep and secure fit of twelve typical ¾" PVC plumbing pipes, schedule 40. The opposite, lower end of pipes will elegantly slide over twelve steel stakes anchored to the ground, as described later herein.

The outer layer 10 is identical in shape and positioning of door and windows as the inner layer 15, only slightly larger to accommodate a three or four inch air gap that will generate its thermal efficiency, and it is without a floor. The bottom perimeter is an additional six inches in length, and is composed of a white waterproof fabric rim with five inch deep hollow pockets 27 at every 16 inches, totaling thirty pockets, as seen in FIG. 7 and FIG. 8. Twenty four stake loops 25 are firmly sewn to the outer rim.

The outer layer 10 windows 14 consist of clear vinyl of at least 12 gauge thickness framed by zippers around arched portion, and sewn permanently at the horizontal bottom border which is positioned at three feet from the floor. When opened it can be left hanging down between wall layers and away from the wind. The door 13 is likewise setup mimicking the inner layer door. When it is desirable for this door to remain open, it can be folded and slid sideways into the gap offered between wall layers.

All zippers discussed herein are covered by a durable, finished fabric frame, overlapping the zipper by one or two inches so as to not be seen, adding a pleasant esthetic, altering the structure from a sporty and convenient finish to a sophisticated and classic design. For the exterior, it protects zippers from rain, dust and sun exposure. All sixteen zippers of portable building 9 have two pulls, allowing them to be adjusted into a variety of positions, from fully closed, to partly open m a variety of positions, to fully open. The door zipper pulls are double, that is, each pull has tags facing the interior and exterior for ease of opening and closing. All window zippers are single pull and can only be managed from the inside, offering occupants control and privacy.

Lastly, FIG. 9 illustrates one of thirty six waterproof bags 26 of 15 inches by 4 inches are sewn on three sides with fourth narrow side left open. A narrow fabric tie attaches to open end for easy sealing.

The inner layer 15 weighs 65 pounds, and the outer layer 10 weighs 55 pounds. Combined with the hub 21 the total weight of transportation is less than 140 pounds. The portable building 9 is easy to carry because the weight of neatly folded layers is distributed between two extra-large contractor size bags.

Figure 5:
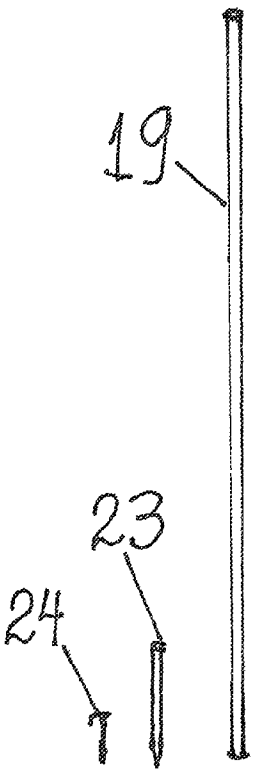
FIG. 5 is a front view of tent peg, ground stake and flexible pipe of the portable building of the present invention.

To prepare for setup of this building 9, have ready twelve ¾" PVC schedule 40 pipes 19 cut to 14 feet in length and twelve rebar or ground stakes of steel up to ¾" thick, of three feet in length, as shown in FIG. 5. For long term set up, have also twenty-four tent stakes and two bags sand or gravel, totaling 100 pounds. Have ready one rope of 25 feet in length, 2 shorter ropes of 10 feet each, a mallet or sledge hammer, and two A-framed ladders of 4 feet and 8 feet. To setup this portable building 9, first erect inner layer 15, then slide outer layer 10 over it, as follows:

To erect the inner layer 15 of building, choose a relatively level area outdoors, or level the ground with a shovel and rake as needed. The building 9 can equally be assembled on a round wood platform or a concrete floor. Hammer twelve steel ground stakes 23 of three feet in length into the soil, evenly spaced around a circle of fifteen foot diameter traced at your desired building location. Using a mallet or sledge hammer make sure the stakes are sufficiently deep so they cannot be pulled out manually, about twelve to eighteen inches. This preparation will ensure the building 9 will sustain high winds without any concerns. When erecting on an impenetrable surface, such as concrete, a simple dodecagon wooden frame 28 of the perimeter of building 9 is setup, each side having a 1-⅛" hole for inserting the PVC pipe 19.

Lay your inner layer 15 directly on the ground or on top of a 4-foot A-frame ladder, where underside of floor hangs over ladder, and hub 21 rests above center top of canvas draped over ladder. Slip twelve PVC pipes 19 through twelve upper closed sleeves 17 and insert into the hub holes 22. Bend bottom end of PVC pipes 19 and slide them over their respective steel stakes 23, lining up the door 13 in the chosen direction. As each pipe 19 slides into position, center hub 21 with attached inner layer 15 gradually lifts by itself until hub 21 is suspended ten feet from the ground. Outer sleeves 18 are securely fastened by connecting the continuous hook and loop 20 of lower open sleeves, one by one, until all twelve sleeves are fastened. This perfects the hemispherical shape and completes the inner layer 15 setup. Twelve tent stake loops 25 located between each vertical frame at ground level can be staked down with simple tent stakes 24 to hold the waterproof floor to the ground in a perfectly round position, and to increase tautness of walls 11. The structure is now habitable as it is for a basic shelter, but not really yet suitable for heavy rains, dust, hot or cold weather. For this the outer layer 10 is needed to slide over the existing frame.

The outer layer 10 is shaped exactly as the inner layer 15 without a floor. Firmly tie one to three ropes to bottom of three nearby wall panels 11, all in the same general side. Toss the center rope of 25 feet over the top of standing structure and start pulling its end from the other side. Use the side ropes of 10 feet to slide the sides of outer layer 10 over and around standing structure. When there are three or four people working together, the outer layer 10 will slide over within a few minutes. For a person working alone it is easier to have an 8-vfoot tall A-frame ladder, placed ten feet or so away from structure so as to have better pulling leverage. Additionally, place said ladder inside the structure 15, open the unseen zipper at the center top 12, exposing the hub 19, and pull on fabric of outer layer 10 tin the desired direction. The outer layer 10, once it crosses the center hub 19, will quickly slide down and fall around standing structure like a skirt. Line up the window 14 and door 15 openings of both wall layers by gently rolling the outer layer 10 about three feet up and rotating it to its perfect position. Pull down on outer layer 10 bottom all the way around and use stake loops 24 to secure it in position. For prolonged setup, for high winds or for winter climates, fill thirty six gravel bags 26 with gravel or sand, tie the ends, and insert them all around outer layer 10 gravel pockets to virtually seal the bottom of outer layer 10 from any contact with the external environment. This also distributes the air pressure from a storm evenly throughout the bottom rim of outer layer 10, completely eliminating the danger of fabric tearing at seams of stake loops. If needed for extra reinforcement, use the twelve additional stake loops 25 and hammer appropriate tent stakes 24 all around. The setup is now complete.

4. How to Use the Invention

The applications for use of this portable building are nearly limitless. Because it is durable and stable, humans and equipment alike can fair well for short or extended periods of time in all terrain.

Because it can be quickly assembled and disassembled, it can be used inside auditoriums, gymnasiums, and schools for educational purposes.

Outdoors it can be set up during art fairs and festivals, trade shows, farm stands, sporting events, medical triage, as a rest shelter, and during the filming of movies.

Because it is lightweight it can be carried to remote locations and is fully functional off-grid for long periods of time with minimal auxiliary equipment. As such it has profoundly beneficial applications for humanitarian aid during emergencies of war, natural catastrophes, relief missions, and other circumstances of population displacement, such as those who are temporarily economically disadvantaged.

Likewise, the government and its various branches including the military, the Department of Energy, the Department of Health, FEMA, and others can utilize these novel portable buildings for supplies, equipment or personnel use.

Scientists doing field work, or in need of a portable planetarium; construction workers in need of an excavation cover, industrial welders in need of an enclosure, and others in these industries, can also benefit.

For sports and recreation, said building can be used for ice fishing, as a deer stand, as hunting quarters, wilderness camping, nature observation, as a jacuzzi and pool cover.

Taking into account its simple yet elegant design, it is specially conducive for therapeutic applications such as a spa room for massage therapy and facials, for yoga and exercise instruction, individual and group therapy, retreats and as a meditation room.

It can be used as a backyard getaway, for entertaining, during weddings, parties and reunions.

It is equally versatile as a private office, or to host office meetings, and depending on size it can serve major corporate events.

Because of its stability and durability it may stay fixed in one location indefinitely and used as an extension of the house serving a specific function such as a home office space, an artist's den, a relaxation and contemplation environment, a place to entertain, a children's playroom, as extra storage, a place to cook, to sleep, and to be connected to nature during inclement and pleasant weather.

Artists may specially enjoy the arched spacious design along with the warn-toned filtered light the structure produces, both when it is sunny and overcast, and enjoy using it for painting, photography, pottery, and much more.

Finally, its value as a greenhouse that is efficient to warm in the winter and easy to ventilate in the summer, while reducing UV damage on foliage is remarkable.

In summary, its scope is nearly endless, providing immediate housing for short or long term use, requiring very little auxiliary utilities to meet the full range of human comforts.

5. Examples of the Invention

Thus it will be appreciated by those skilled in the art that the present invention is not restricted to the particular preferred embodiments described with reference to the drawings, and that variations may be made without departing from the scope of the present invention as defined in the appended claims and equivalents thereof.

What is claimed is:

1. A portable building comprising:

a support frame, further comprising:

a minimum of eight ground stakes driven vertically into the ground and equally spaced in a circular pattern of an overall circumference of said building, whereby said stakes further comprise an upper end and a lower end, whereby the lower end of each ground stake is driven at right angles into the ground, and whereby the upper end of each said ground stake protrudes vertically upward from the ground;

a central top weight-bearing hub comprising a minimum of eight receptacles, their number being equal to the number of said ground stakes, equally spaced around a circumference of said hub such that said receptacles point radially outward from a center of said hub and align in the same direction as each said ground stake: and a minimum of eight flexible poles, their number being equal to the number of said ground stakes, each pole further comprising an upper end, a lower end and a middle support section, each pole's upper end inserting into its corresponding receptacle of said central top hub, and each pole's lower end inserting over or into said ground stakes, wherein each pole's lower end is perpendicular to the ground, resulting in a hemispherical shape of the support frame;

an inner fabric layer, further comprising:

a minimum of eight petal-shaped fabric panels, their number being equal to the number of said ground stakes, each petal-shaped fabric panel further comprising an upper side, a lower side and two concave-curved vertical sides, each petal-shaped fabric panel sewn together adjacently along their concavely curved vertical sides to form a substantially hemispherical shape thus providing an inside surface and an outside surface of said inner fabric layer;

a circular-shaped fabric panel sewn along its entire circumference to the upper sides of each, said petal-shaped fabric panel;

a circular-shaped waterproof fabric panel sewn along its entire circumference to the lower sides of each said petal-shaped fabric panel creating a floor for the inner fabric layer; and a minimum of eight cylindrical fabric sleeves, their number being equal to the number of said ground stakes, wherein each said sleeve comprises a lengthwise dimension substantially equal to the vertical side length of said petal-shaped panels, and each said sleeve sewn lengthwise to the outside of said inner fabric layer along their curved vertical side;

an outer fabric layer, further comprising:

a minimum of eight petal-shaped fabric panels, their number being equal to the number of said ground stakes, each petal-shaped fabric panel further comprising an upper side, a lower side and two vertical sides, each petal-shaped fabric panel sewn together adjacently along their vertical sides to form a substantially hemispherical shape thus providing an inside surface and an outside surface of said outer fabric layer;

a circular-shaped fabric panel sewn along its entire circumference to the upper sides of each said petal-shaped fabric panel, and placed over the inner fabric layer and the support frame;

wherein a bottom rim sewn along its entire circumference to the lower sides of each said petal-shed fabric panel, the bottom rim possesses a minimum of eight reinforced fabric loops, said loops to hold said outer fabric layer in place with tent pegs anchored to the ground; and a waterproof fabric compartment sewn along the entire lower circumference of the bottom rim containing within it tubular sacks filled with gravel, rock, metal or sand.

wherein the overall size of said outer fabric layer is constructed to fit and conform over the support frame;

wherein the air space formed between said inner and outer fabric layers provides a layer of insulation against the ambient temperature;

wherein said ground stake's vertical protrusion above the ground is a structural component of said support frame that stabilizes said flexible poles lower ends in a rigid vertical alignment; and wherein the hemispherical shape of said flexible poles is maintained under pressure by the combined action of said vertically protruding rigid ground stakes holding said flexible poles lower ends curved in the direction of the center of said building, and the weight of said central top hub exerting downward pressure against said flexible poles upper ends.

2. A portable building according to claim 1, wherein the fabric cylindrical sleeve of the inner fabric layer continuously covers the flexible pole throughout its length, evenly securing the weight of the inner fabric layer throughout its embodiment, and evenly distributing the weight of said inner fabric layer along the length of each said flexible pole and maximizing said flexible pole's performance under tension.

3. A portable building according to claim 1, wherein the fabric cylindrical sleeves of the inner fabric layer surrounding a single one of the flexible pole comprise closed cylindrical sleeves or open fabric strips fastened to each other lengthwise by hook and loop fasteners or zippers.

4. A portable building according to claim 1, wherein the center top circle of the inner fabric layer is fastened to the petal-shaped vertical fabric panels by a seam, a zipper or a hook and loop fastener.

5. A portable building according to claim 1, wherein the fabric materials are cotton, nylon, polyester, vinyl, acrylic, PVC, or a combination.

6. A portable building according to claim 1, wherein the fabric panels weigh 10-13 ounces per square yard.

7. A portable building according to claim 1, wherein the fabric compartment of the lower rim of the outer layer is sealed on top, and open on the bottom with hook and loop fastener or zipper closure.

8. A portable building according to claim 1, wherein the poles of the support frame are flexible poles of plastic, metal, wood, or a composite.

9. A portable building according to claim 1, wherein the inner fabric layer having a door and windows consisting of a privacy blind and netting.

10. A portable building according to claim 1, wherein the outer fabric layer having a door and windows consisting of clear vinyl.

11. A portable building comprising:

a support frame, further comprising:

a central top weight-bearing hub comprising a minimum of eight receptacles equally spaced around a circumference of said hub such that said receptacles point radially outward from a center of said hub;

a rigid circular or polygonal ground frame of the circumference of said building, containing a minimum of eight vertical ground frame receptacles equally spaced around said ground frame, aligned in the same direction as each said hub receptacle, and fabricated from wood;

a minimum of eight flexible poles, their number being equal to the number of said hub receptacles, each pole further comprising an upper end, a lower end and a middle support section, each pole's upper end inserting into its corresponding receptacle of said central top hub, and each pole's lower end inserting over or into said ground frame receptacles, wherein each pole's lower end is perpendicular to the ground, resulting in a hemispherical shape of the support frame;

an inner fabric layer, further comprising:

a minimum of eight petal-shaped fabric panels, their number being equal to the number of said ground frames receptacles, each petal-shaped fabric panel further comprising an upper side, a lower side and two concave-curved vertical sides, each petal-shaped fabric panel sewn together adjacently along their concavely curved vertical sides to form a substantially hemispherical shape thus providing an inside surface and an outside surface of said inner fabric layer;

a circular-shaped fabric panel sewn along its entire circumference to the upper sides of each said petal-shaped fabric panel;

a circular-shaped waterproof fabric panel sewn along its entire circumference to the lower sides of each said petal-shaped fabric panel creating a floor for the inner fabric layer; and a minimum of eight cylindrical fabric sleeves, their number being equal to the number of said ground frame receptacles, wherein each said sleeve comprises a lengthwise dimension substantially equal to the vertical side length of said petal-shaped panels, and each said sleeve sewn lengthwise to the outside of said inner fabric layer along their curved vertical side;

an outer fabric layer, further comprising:

a minimum of eight petal-shaped fabric panels, their number being equal to the number of said ground frames receptacles, each petal-shaped fabric panel further comprising an upper side, a lower side and two vertical sides, each petal-shaped fabric panel sewn together adjacently along their vertical sides to form a substantially hemispherical shape thus providing an inside surface and an outside surface of said outer fabric layer;

a circular-shaped fabric panel sewn along its entire circumference to the upper sides of each said petal-shaped fabric panel, and placed over the inner fabric layer and the support frame;

wherein a bottom rim sewn along its entire circumference to the lower sides of each said petal-shed fabric panel, the bottom rim possesses a minimum of eight reinforced fabric loops, said loops to hold said outer fabric layer in place with tent pegs anchored to the ground; and a waterproof fabric compartment sewn along the entire lower circumference of the bottom rim containing within it tubular sacks to be filled with gravel, rock, metal or sand to hold down said building.

wherein the overall size of said outer fabric layer is constructed to fit and conform over the support frame;

wherein the air space formed between said inner and outer fabric layers provides a layer of insulation against the ambient temperature.

* * * * *